US009193080B2

(12) United States Patent
Whelan et al.

(10) Patent No.: US 9,193,080 B2
(45) Date of Patent: Nov. 24, 2015

(54) SHAVING BLADE UNIT WITH SELF-LEVELING TRIMMER

(75) Inventors: Trevor John Whelan, Thatcham (GB); Paul Leslie Warrick, Woodcote (GB)

(73) Assignee: The Gillette Company, Boston, MA (US)

( * ) Notice: Subject to any disclaimer, the term of this patent is extended or adjusted under 35 U.S.C. 154(b) by 923 days.

(21) Appl. No.: 12/534,216

(22) Filed: Aug. 3, 2009

(65) Prior Publication Data

US 2011/0023305 A1 Feb. 3, 2011

(51) Int. Cl.

| | |
|---|---|
| ***B26B 19/00*** | (2006.01) |
| ***B26B 19/42*** | (2006.01) |
| ***B26B 21/00*** | (2006.01) |
| ***B26B 21/52*** | (2006.01) |
| ***B26B 21/22*** | (2006.01) |
| ***B26B 21/40*** | (2006.01) |

(52) U.S. Cl.

CPC ..... *B26B 21/227* (2013.01); *B26B 21/4012* (2013.01); *B26B 21/4031* (2013.01); *B26B 21/4043* (2013.01)

(58) Field of Classification Search

CPC .... B26B 19/00; B26B 21/00; B26B 21/4012; B26B 21/4037; B26B 21/4025; B26B 29/00

USPC ..... 30/34.1, 34.2, 50, 41, 41.5, 527, 532, 30/346.51, 346.55, 346.56, 169

See application file for complete search history.

(56) References Cited

U.S. PATENT DOCUMENTS

| | | | | |
|---|---|---|---|---|
| 3,644,990 | A * | 2/1972 | Crookes | 30/34.1 |
| 3,995,368 | A * | 12/1976 | Yamada et al. | 30/34.1 |
| 4,274,199 | A * | 6/1981 | Gallanis et al. | 30/34.1 |
| 4,285,124 | A * | 8/1981 | Diakonov | 30/34.1 |
| 4,380,869 | A * | 4/1983 | Shirakawa et al. | 30/34.1 |
| 5,022,153 | A * | 6/1991 | Baron | 30/34.1 |
| 5,052,106 | A * | 10/1991 | Labrijn | 30/34.1 |
| 5,678,312 | A * | 10/1997 | Watanabe | 30/43.92 |
| 5,701,673 | A * | 12/1997 | Ullmann et al. | 30/34.1 |
| 5,946,806 | A * | 9/1999 | Watanabe et al. | 30/43.92 |
| 6,173,498 | B1 * | 1/2001 | Warrick et al. | 30/50 |
| 6,205,666 | B1 * | 3/2001 | Junk | 30/43.92 |
| 6,276,061 | B1 * | 8/2001 | Rozenkranc | 30/34.1 |
| 6,526,660 | B1 * | 3/2003 | MacNeil | 30/61 |
| 6,601,302 | B2 * | 8/2003 | Andrew | 30/34.1 |
| 6,957,490 | B2 * | 10/2005 | Wilcox | 30/34.1 |
| D588,309 | S | 3/2009 | Wonderley | |
| 7,536,787 | B2 * | 5/2009 | Blaustein et al. | 30/34.05 |
| 7,617,607 | B2 | 11/2009 | Pennell et al. | |

(Continued)

FOREIGN PATENT DOCUMENTS

WO WO 2005/011930 A1 2/2005

OTHER PUBLICATIONS

PCT International Search Report dated Nov. 9, 2010.

*Primary Examiner* — Ghassem Alie
*Assistant Examiner* — Bharat C Patel
(74) *Attorney, Agent, or Firm* — Ronald Terk Sia; Kevin C. Johnson; Steven W. Miller

(57) ABSTRACT

A shaving razor blade unit including a housing having a primary guard at a front of the housing and a primary cap at an upper surface at a back of the housing. One or more primary shaving blades are positioned between the primary guard and the primary cap. A trimming blade is pivotally mounted at the back of the housing and has a cutting edge.

18 Claims, 10 Drawing Sheets

(56) References Cited

U.S. PATENT DOCUMENTS

| | | | | |
|---|---|---|---|---|
| 7,761,998 | B2 * | 7/2010 | Blaustein et al. | 30/34.05 |
| 7,810,240 | B2 | 10/2010 | Lee et al. | |
| 2004/0055156 | A1 * | 3/2004 | Brown, Jr. | 30/34.1 |
| 2005/0022386 | A1 * | 2/2005 | Macove | 30/50 |
| 2005/0198829 | A1 * | 9/2005 | Gray et al. | 30/50 |
| 2005/0217115 | A1 * | 10/2005 | Blaustein et al. | 30/34.1 |
| 2005/0223568 | A1 * | 10/2005 | Walker et al. | 30/346.57 |
| 2006/0174488 | A1 * | 8/2006 | Walker et al. | 30/50 |
| 2006/0179661 | A1 * | 8/2006 | Walker et al. | 30/50 |
| 2006/0196054 | A1 * | 9/2006 | Luxton | 30/50 |
| 2007/0283567 | A1 | 12/2007 | Magli | |
| 2008/0172878 | A1 * | 7/2008 | Luxton | 30/34.1 |
| 2008/0250647 | A1 * | 10/2008 | Fischer et al. | 30/50 |
| 2009/0077809 | A1 | 3/2009 | Lee et al. | |
| 2010/0011583 | A1 | 1/2010 | Efthimiadis et al. | |
| 2010/0011584 | A1 | 1/2010 | Efthimiadis et al. | |
| 2010/0299928 | A1 | 12/2010 | Clarke et al. | |

* cited by examiner

SHAVING BLADE UNIT WITH SELF-LEVELING TRIMMER

FIELD OF THE INVENTION

The present invention relates to shaving razors and more particularly to shaving razor blade units having a self leveling trimmer blade.

BACKGROUND OF THE INVENTION

In recent years shaving razors with various numbers of blades have been proposed in the patent literature and commercialized such as the three-bladed Mach 3™ razor and the five bladed Fusion™ razor by The Gillette Company.

Increasing the number of blades on a shaving razor generally tends to increase the shaving efficiency of the razor and provide better distribution of compressive forces on the skin but it can also tend to increase drag forces, reduce maneuverability, and reduce the ability to trim, e.g., sideburns or near the nose. To solve this problem an extra blade can be mounted at the rear of the razor housing for trimming.

Short hairs are typical of hair growth of approximately twenty-four hours. The edge of a trimming blade on the razor is able to cut the short hair at an optimum angle if the blade unit is oriented at the appropriate cutting angle during use. However, it is unlikely that a user has any knowledge that the trimmer unit has been designed with an optimum cutting angle in mind. What's more, even if they where aware, it would be difficult if not impossible to position the razor so that the trimmer blade is oriented in the optimum cutting angle. As a result, not all consumers are getting the best results from their trimmer.

It is therefore desirable to provide a trimming element that presents the blade to the skin and maintains an optimum cutting angle during use to maximize efficiency.

SUMMARY OF THE INVENTION

In one aspect, the invention features, in general, a shaving blade unit having a self leveling trimmer assembly. The shaving blade unit comprises a housing having a front, a back and two sides extending from the front to the back with one or more shaving blades disposed within the housing between the front, back and two sides. A trimming assembly is pivotally mounted at the back of the housing. The trimming assembly comprises a trimming blade having a cutting edge, wherein the trimming assembly rotates and presents the cutting edge at an optimal skin to blade cutting angle and maintains the cutting angle during use to maximize cutting efficiency.

In one embodiment, the trimming assembly comprises a frame pivotally mounted to a pivotal interface at the back of the housing. The pivotal interface can comprise pins disposed at the back and on opposite sides of the housing where the frame is connected to the pins via c-shaped members disposed on the ends of the frame. The pivotal interface can also comprise pivot assemblies on the frame such as ball shaped or cone shaped pivots on opposing ends of the frame that interface with similarly shaped apertures in the housing. In one embodiment, the pivot assemblies comprise shell bearing pivots on the ends of the frame that interface with shell shaped apertures in the housing. In another embodiment the pivot assemblies comprise torsion elastomers disposed on the ends of the frame that interface with slots in the housing.

The frame supports a trimming blade having a cutting edge, a trimming guard disposed in front of the cutting edge of the trimming blade and a trimming cap disposed behind the cutting edge of the trimming blade. The trimming guard and trimming cap include skin contact points which contact the skin of the user during use. The optimal cutting angle of the trimming blade is set at an angle relative to a plane tangent to the trimming guard skin contact point and the trimming cap skin contact point. Since the frame is designed to rotate, once contact is made with one of the two skin contact points, the frame rotates so that both skin contact points make contact. As a result, the trimming blade is oriented in the optimal cutting angle regardless of the approach angle of the trimming assembly to the skin.

In another embodiment, the housing includes a primary guard at the front of the housing and a primary cap at an upper surface at the back of the housing. The one or more shaving blades are disposed within the housing between the primary guard and the primary cap. For this embodiment, the self leveling trimmer blade is disposed behind the primary cap.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

The shaving blade unit with the self leveling trimmer according to the present invention will be described with reference to the following figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

Figure 1:
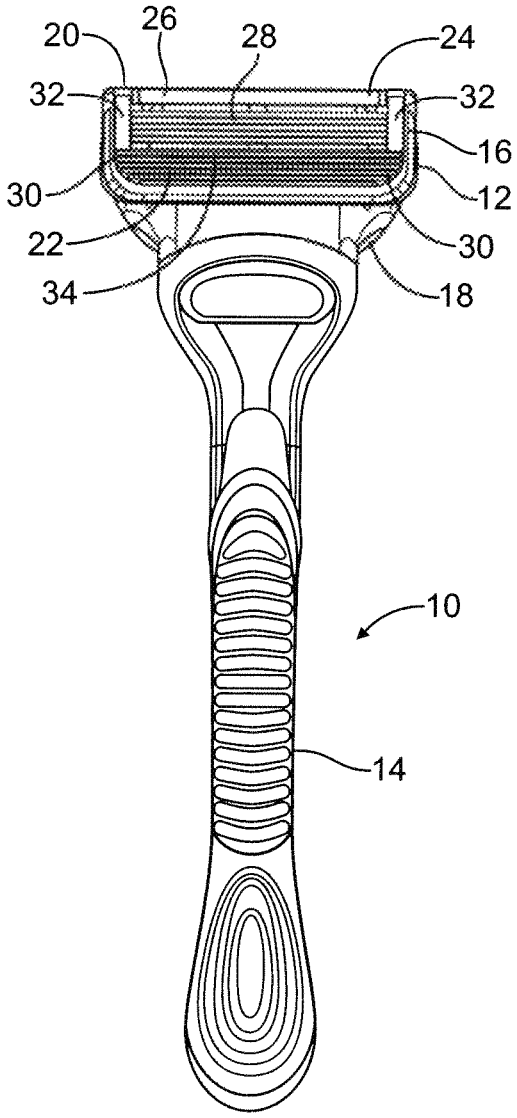
FIG. 1 is a front view of one possible embodiment of a shaving razor.

Referring to FIG. 1, shaving razor 10 includes disposable cartridge 12 and handle 14. Cartridge 12 includes a connecting member 18, which connects to handle 14, and a blade unit 16 which is pivotally connected to connecting member 18. Blade unit 16 includes plastic housing 20, primary guard 22 at the front of housing 20 and primary cap 24 at the rear of housing 20. The primary guard 22 may have a plurality of fins 25 spaced apart from each other that extend longitudinally along a length of the housing 20. The primary cap 24 may have a lubricating strip 26. Elongated primary shaving blades 28 are positioned between primary guard 22 and primary cap 24. Although five primary shaving blades 28 are shown, it is understood that more or less primary shaving blades 28 may be mounted within the housing 20. The blades 28 are shown secured within the housing 20 with clips 32; however, other assembly methods known to those skilled in the art may also be used. These and other features of shaving razor 10 are described in U.S. Pat. No. 7,168,173.

Figure 2:
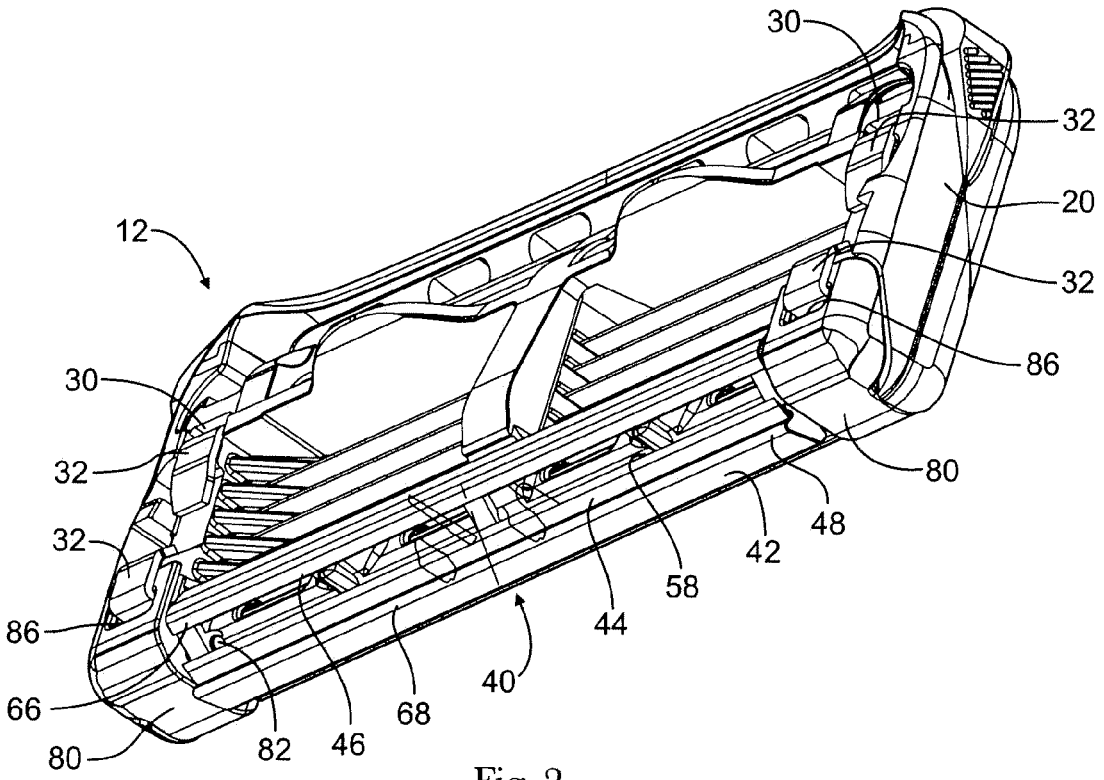
FIG. 2 is a perspective view of the bottom of a razor blade unit showing the trimming assembly.
Figure 3:
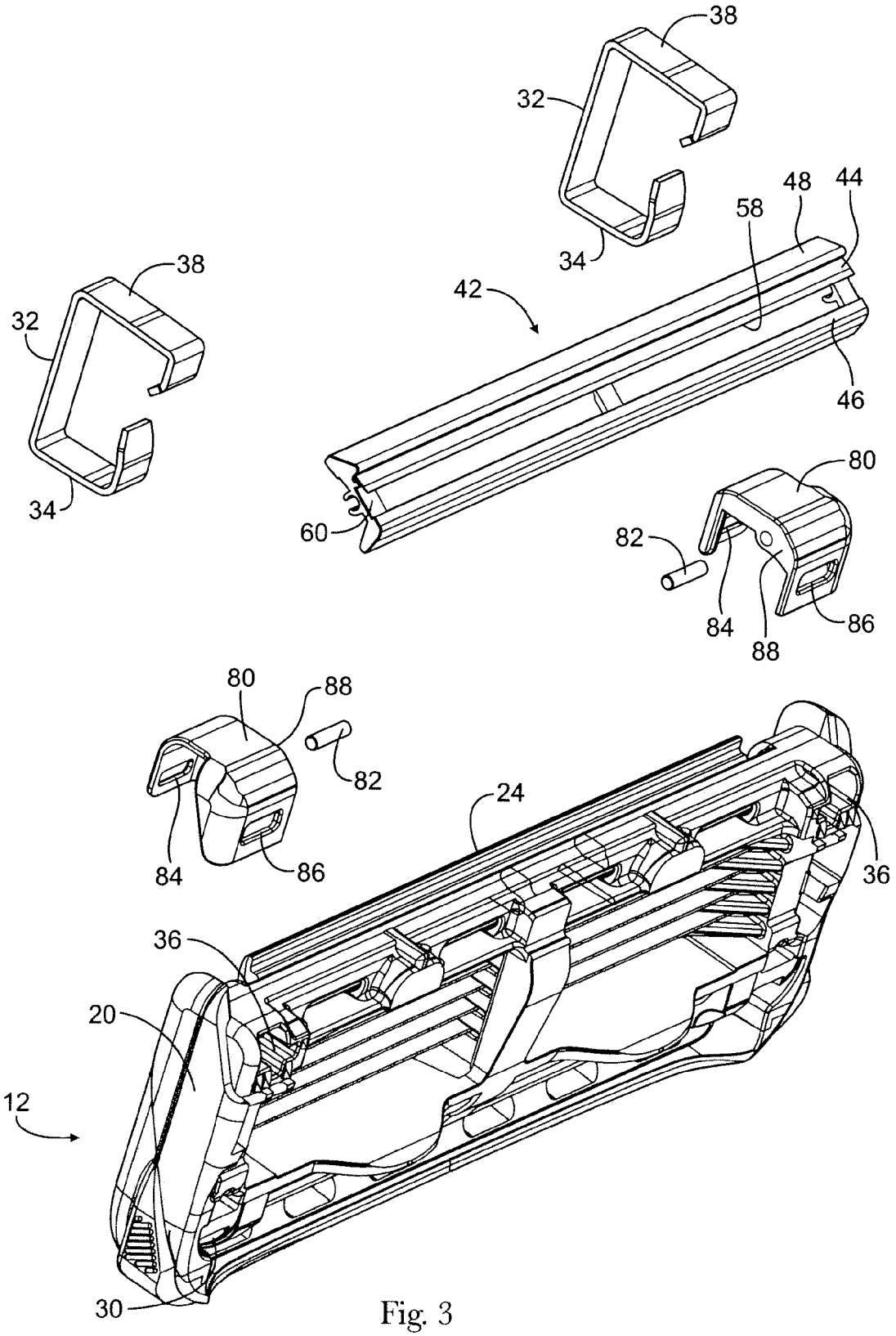
FIG. 3 is an exploded view of the cartridge in FIG. 2 showing the components of a trimming assembly removed from the razor blade unit.

Referring to FIG. 2 and FIG. 3, cartridge 12 includes a trimming assembly 40 mounted to the back of housing 20. The trimming assembly 40 includes a frame 42 pivotally mounted to the housing 20. The frame 42 can comprise a wire cut metal or molded plastic substrate. Alternatively, the frame 42 can be made of 0.011 inch thick stainless steel sheet metal. In either case the material is cut and formed to provide features for pivotally attaching the frame 42 to the housing 20 and for supporting trimming blade 44. The frame 42 can also include a trimming guard 46 located in front of the trimming blade 44 and a trimming cap 48 located behind the trimming blade 44. Trimming blade 44 mounted on the frame 42 includes a trimming cutting edge 58. For the embodiment shown in FIG. 2 and FIG. 3, swivel mounts 80 are secured to the back of housing 20 by clips 32 and the frame 42 is pivotally mounted to the swivel mounts 80 via pins 82 disposed in opposing faces 88 of the swivel mounts 80. In alternate embodiments discussed below, the frame 42 may be pivotally mounted directly to the housing 20 such that the structural features providing the pivotal interface comprise an integral part of the plastic housing 20.

Figure 4A:
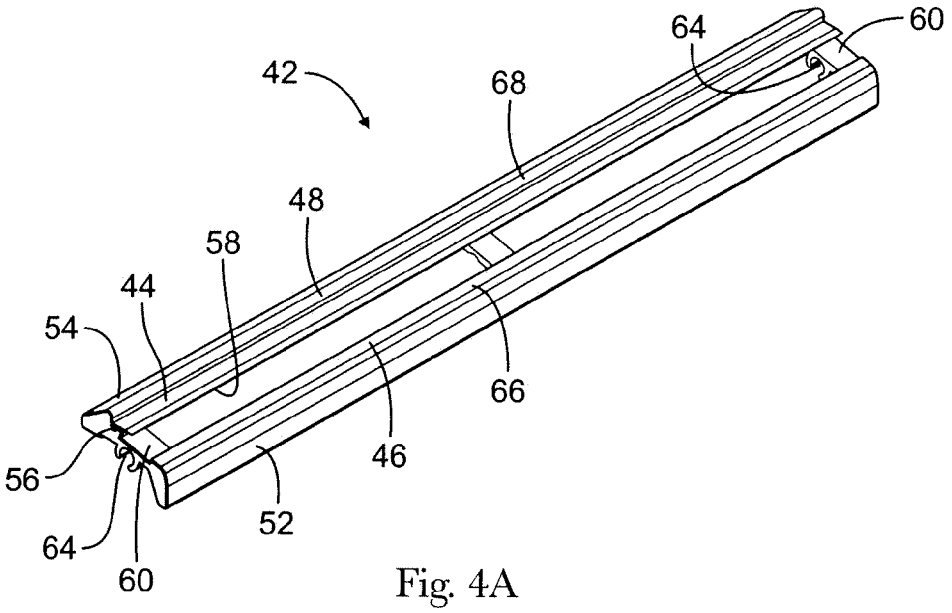
FIG. 4*a* is a perspective view of the frame portion of the trimming assembly.
Figure 4B:
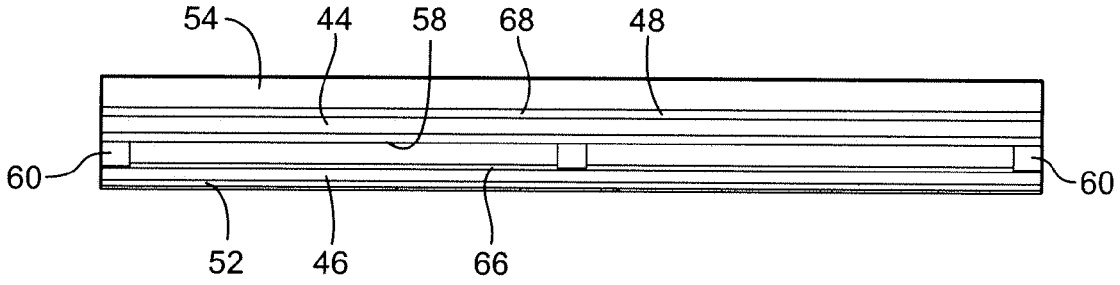
FIG. 4*b* is a top view of the frame portion of the trimming assembly.
Figure 4C:
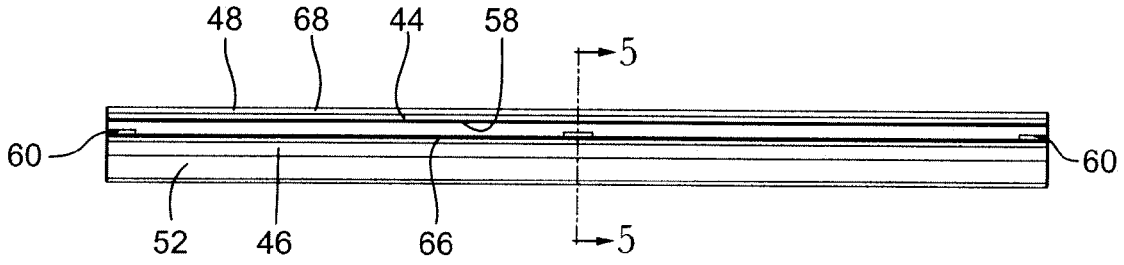
FIG. 4*c* is a front side view of the frame portion of the trimming assembly.
Figure 5:
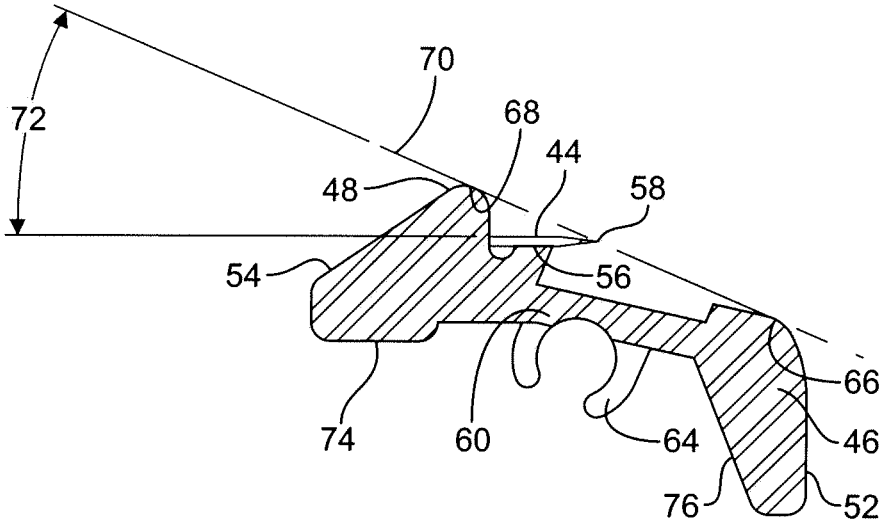
FIG. 5 is a cross-sectional view of the frame in FIG. 4*c*.

As illustrated in FIG. 4*a*-4*c*, frame 42 has a front wall 52, a rear wall 54, and an intermediate wall 56. Brackets 60 on opposing ends of the frame 42 provide fulcrums 64 for pivotally mounting the ends of the frame to the housing 20. The front wall 52 forms the trimming guard 46 and the rear wall 54 forms the trimming cap 48. Trimming blade 44 is welded to the intermediate wall 56 by spot welds with trimming cutting edge 58 in precise position with respect to trimming guard 46 and trimming cap 48. Trimming guard 46 includes skin contact point 66 and trimming cap 48 includes skin contact point 68 both of which interface with the user's skin during use. As shown in FIG. 5, a plane 70 tangent to the skin contact points 66, 68 defines a reference plane from which the optimal cutting angle 72 of the trimming blade 44 is measured. The surface of the intermediate wall 56 is oriented so that the cutting edge 58 of the trimming blade 44 is positioned in the optimal cutting angle 72. For the present invention, the preferred optimal cutting angle 72 ranges from 17° to 35°. Most preferably the optimal cutting angle 72 is about 23.5°.

Figure 6:
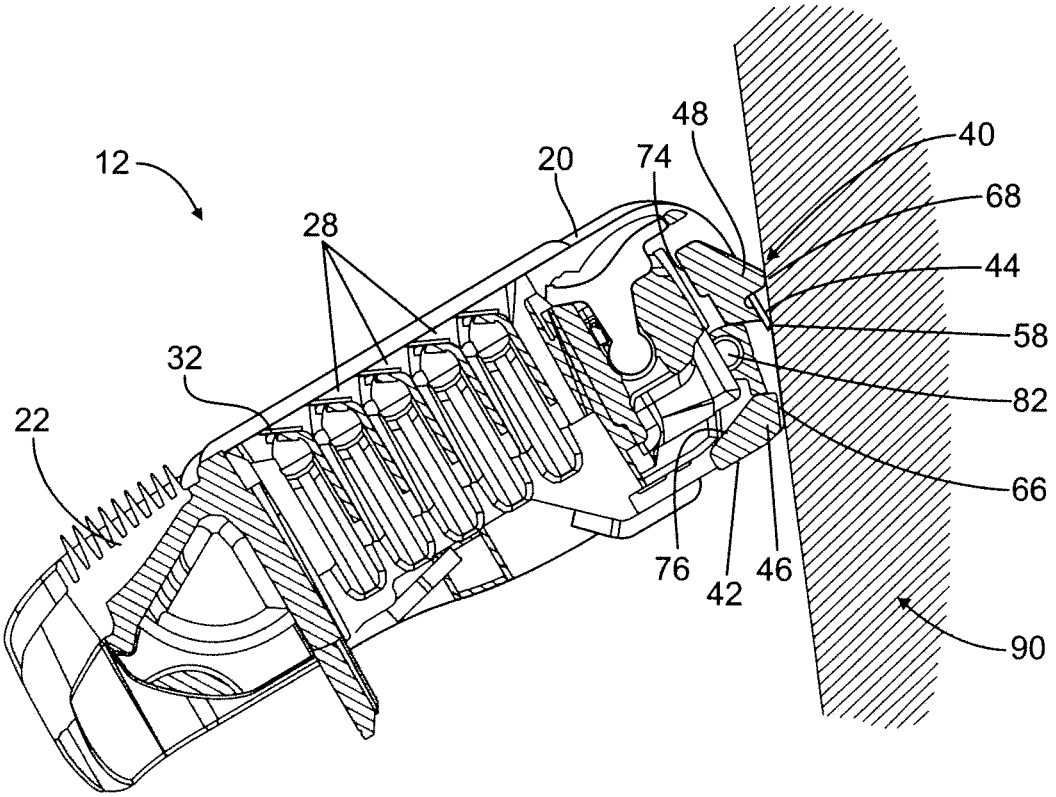
FIG. 6 is a side view of a razor blade unit showing the trimming assembly in use.

As illustrated in FIG. 6, in use, the skin contact points 66, 68 of the trimmer cap 48 and trimmer guard 46 contact the skin 90 of the user. Since the frame 42 is designed to rotate, once contact is made with one of the two skin contact points 66, 68, the frame 42 rotates so that both skin contact points make contact. As a result, the trimming blade 44 is oriented in the optimal cutting angle 72 independent of the approach angle of the trimming assembly 40 during use. The approach angle is the angle between a line that is normal to a point on the trimming assembly that is first to make contact with the skin and a plane tangent to the point of contact on the skin. In addition, due to the rotation of the trimming assembly 40, the optimal cutting angle is maintained through the cutting motion as long as the skin contact points 66, 68 maintain in contact with the skin.

The frame 42 can rotate clockwise and counterclockwise providing an angular range of rotation of about 32°. The rotation of the frame 42 can be limited by the interaction of the trimmer guard 46 and trimming cap 48 with the housing 20. For instance, as shown in FIG. 6 the counterclockwise rotation can be limited by the interaction of the backside 74 of the trimming cap 48 of frame 42 with the housing 20 and the clockwise rotation is limited by the interaction of the backside 76 of the trimming guard 46 of the frame 42 with the housing 20. The frame 42 preferably has a default position where the trimming blade 44 is parallel with the back of the disposable cartridge 12. From the default position, the frame can rotate clockwise or counterclockwise, preferably about 10.5° degrees in the counterclockwise direction and preferably about 21.5° degrees in the clockwise direction providing an angular range of rotation of about 32°.

In manufacture, frame 42 can be cut and formed from sheet metal, comprise a substrate wire cut from a block of metal, or comprise a molded plastic substrate. Trimming blade 44 is placed against interior surface of intermediate wall 56 where it is secured by spot welds. The frame 42 is placed on the back of the housing 20 by sliding it forward over the rear of housing 20 with fulcrum 64 on the brackets 60 of the frame 42 mounting on a pivotal interface on the rear of housing 20. For the embodiment shown in FIG. 3, swivel mounts 80 are placed on the back of the housing 20 by sliding them forward over the rear of the housing 20. The swivel mounts 80 are secured to the housing 20 by clips 32, where second legs 38 of clips 32 pass through upper slots 84 and lower slots 86 on swivel mounts 80 and also through slots 36 in the housing 20. First legs 34 of the clips 32 pass through slots 30 in housing 20. Pins 82 are inserted into holes in opposing sides 88 of the swivel mounts 80. The frame 42 is then placed on the back of housing by sliding it forward over the rear of housing 20 with fulcrums 64 on the brackets 60 of the frame 42 aligned with pins 82 on swivel mounts 80. As shown in FIG. 4*a* and FIG. 5, the fulcrums 64 can include C-shaped members formed in the brackets 60 that snap fit to the pins 82 disposed on the swivel mounts 80.

Figure 7:
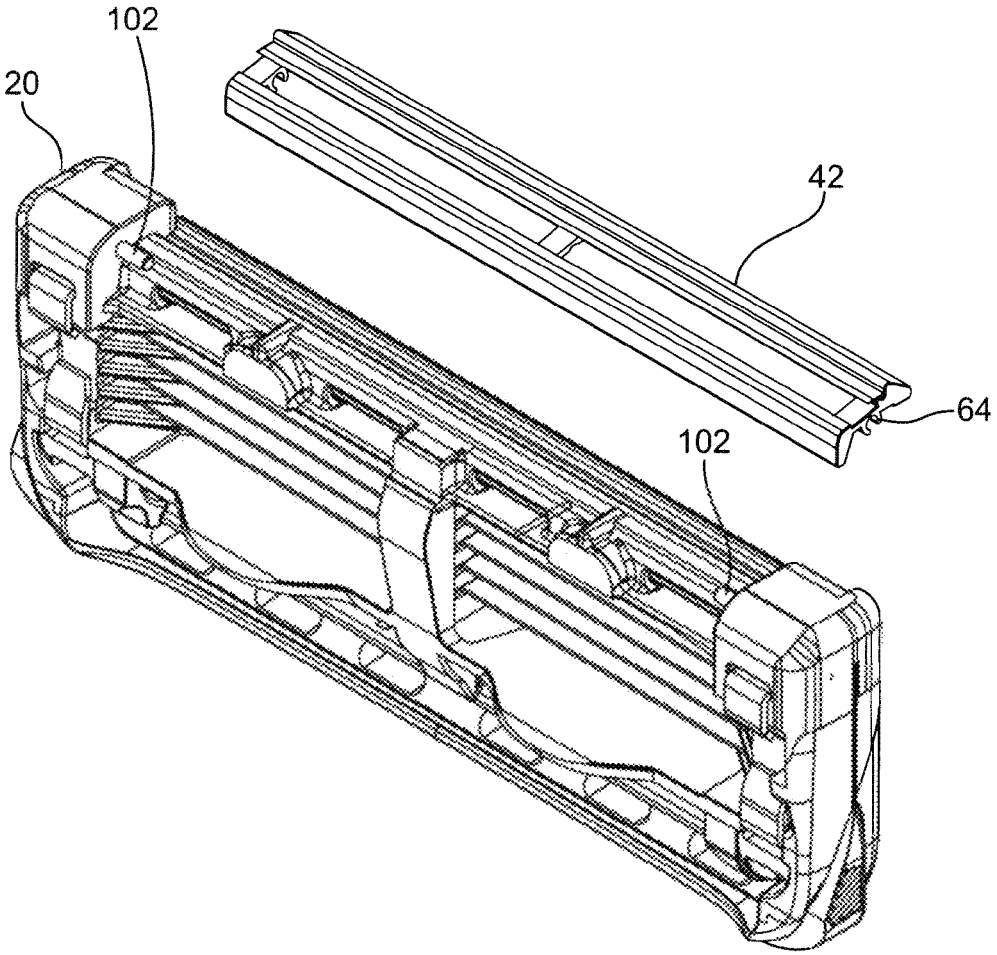
FIG. 7 is a perspective view of the bottom of the razor unit showing the trimming assembly removed from the razor and the pivotal interface of the frame on the housing of the razor.
Figure 8:
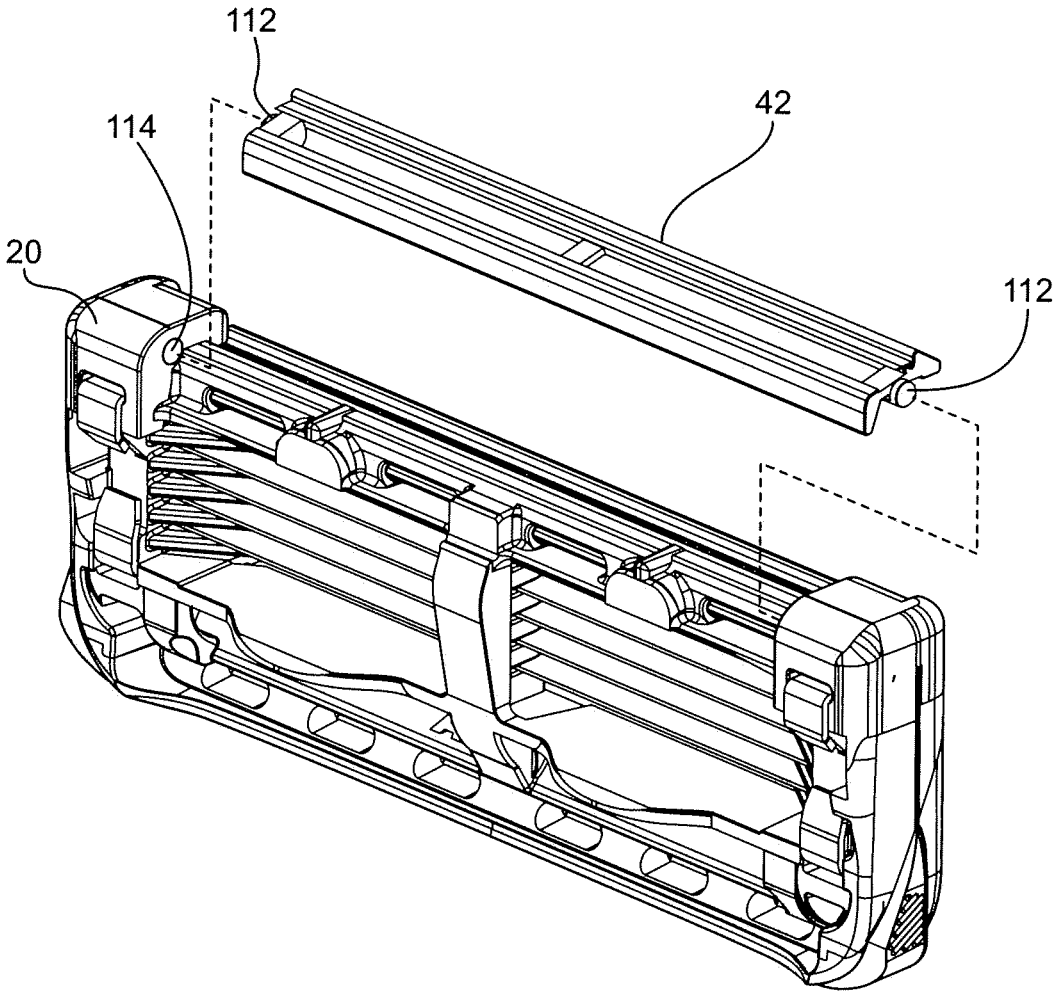
FIG. 8 is a perspective view of the bottom of the razor unit showing the trimming assembly removed from the razor and the pivotal interface comprising ball shaped pivots on the ends of the frame and interfacing ball shaped apertures on the housing of the razor.
Figure 9A:
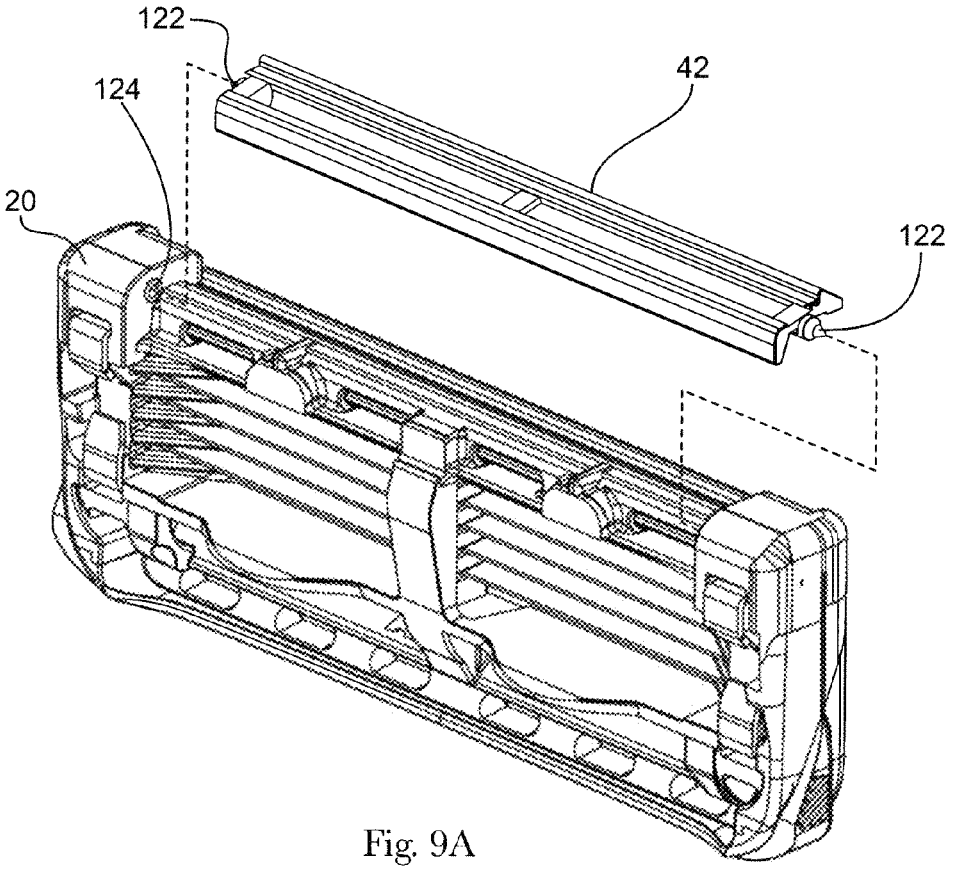
FIGS. 9*a* and 9*b* are perspective views of the bottom of the razor unit showing the trimming assembly removed from the razor and the pivotal interface comprising cone shaped pivots on the ends of the frame interfacing with cone shaped apertures on the housing of the razor.
Figure 9B:
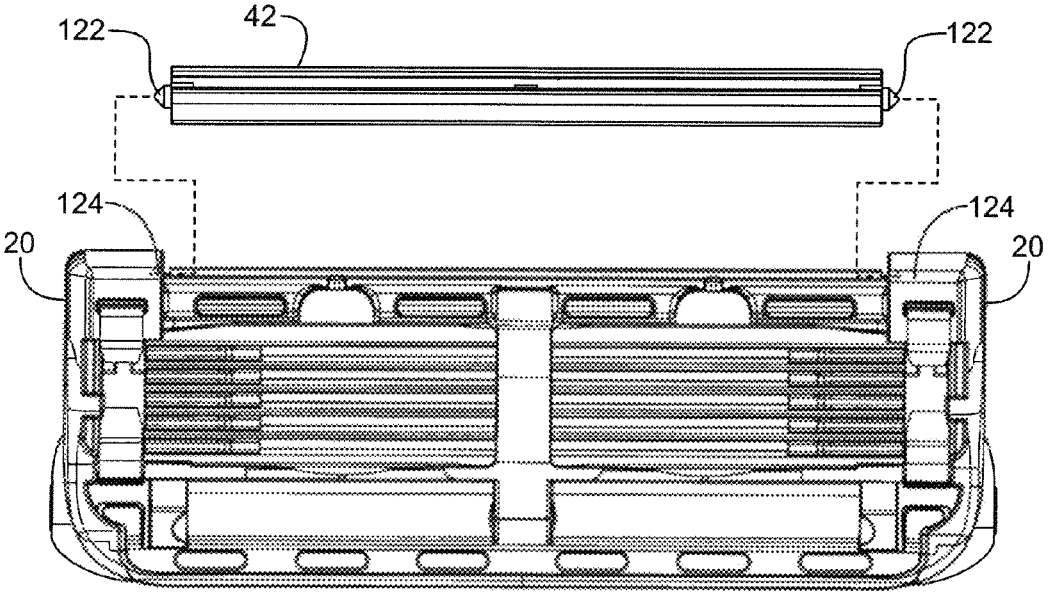

In alternate embodiments shown in FIG. 7 through FIG. 11*c*, the frame can be pivotally mounted directly to a pivotal interface on the frame 42. For instance, as shown in FIG. 7, the pivotal interface can comprise separate pins 102 inserted into apertures in the housing 20. Optionally, the pins 102 can be molded as part of the housing 20. Similar to the previous embodiment, for this embodiment the fulcrums 64 can include C-shaped members formed in the brackets 60 that snap fit to the pins 102.

In other embodiments, the pivoting motion of the frame 42 is dependent upon the design of the fulcrums 64 included on the brackets 60 of the frame 42. For instance, in the embodiment shown in FIG. 8, the fulcrums 64 include ball shaped pivots 112 disposed on the brackets 60 that interface with ball shaped apertures 114 in the housing 20 that receive the ball shaped pivots 112. In another embodiment shown in FIGS. 9*a* and 9*b*, the fulcrums 64 include cone shaped pivots 122 disposed on the brackets 60 that interface with cone shaped apertures 124 in the housing 20.

Figure 10:
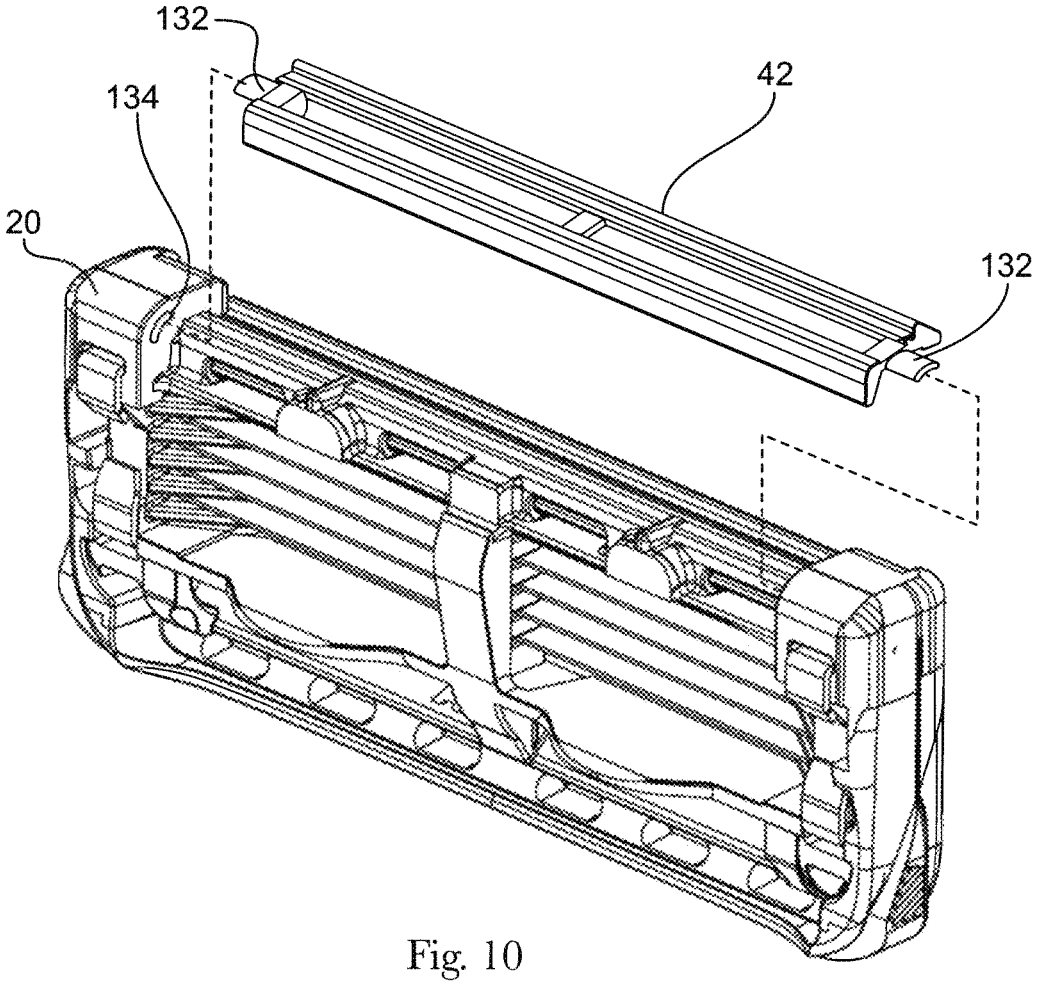
FIG. 10 is a perspective view of the bottom of the razor unit showing the trimming assembly removed from the razor and the pivotal interface comprising shell shaped pivots on the ends of the frame and interfacing shell shaped apertures on the housing of the razor.

In another embodiment shown in FIG. 10, the fulcrums 64 include shell bearing pivots 132 disposed on the brackets 60. The shell bearing pivots 132 interface with shell shaped apertures 134 in the housing 20. The shell shaped apertures 134 are sized and shaped to control the range of motion of the shell bearing pivots 132 and the corresponding rotation of the frame 42. For this embodiment, the shell shaped apertures 134 can be sized and shaped to limit the range of rotation of the frame 42.

Figure 11A:
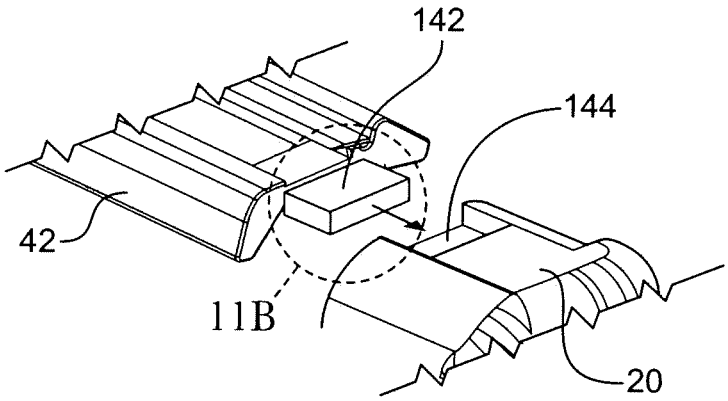
FIGS. 11*a*, 11*b* and 11*c* are end views of the frame of the razor unit showing a pivotal interface comprising torsion elastomers on the ends of the frame interfacing with slots on the housing of the razor.
Figure 11B:
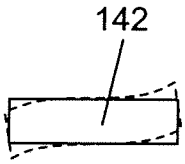
Figure 11C:
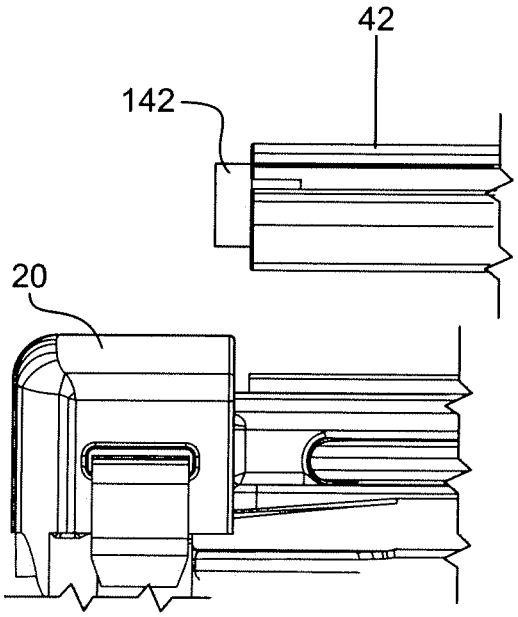

In another embodiment shown in FIGS. 11*a*, 11*b* and 11*c*, torsion elastomers 142 are secured to the brackets 60 on the ends of the frame 42 to enable the pivoting motion of the frame 42. The torsion elastomers 142 interface with slots 144 in the housing 20. For this embodiment, the torsion elastomers 142 deform allowing the frame 42 to pivot or rotate.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving blade unit comprising a disposable cartridge having a self leveling trimming assembly, the disposable cartridge comprising:

a housing having a front, a back and two sides extending from the front to the back;

one or more wet shaving blades disposed within the housing between the front, back and two sides, said one or more wet shaving blades having blade tips oriented towards the front of the housing; and wherein said trimming assembly pivotally mounted at the back of the housing, the trimming assembly comprises a frame supporting a trimming blade having a cutting edge oriented towards the back of the housing, wherein said trimming assembly pivot with respect to the housing about a pivot interface.

2. The unit of claim 1 wherein the frame comprises a trimming guard disposed in front of the cutting edge of the trimming blade wherein the trimming guard includes a skin contact point.

3. The unit of claim 2 wherein the frame further comprises a trimming cap disposed behind the cutting edge of the trimming blade wherein the trimming cap includes a skin contact point.

4. The unit of claim 3 wherein an optimal cutting angle of the trimming blade is set at an angle relative to a plane that is tangent to the trimming guard skin contact point and the trimming cap skin contact point.

5. The unit of claim 4 wherein the optimal cutting angle of the trimming blade ranges from about 17° to about 35°.

6. The unit of claim 4 wherein the optimal cutting angle of the trimming blade is about 23.5° relative to the tangent line.

7. The unit of claim 1 wherein the trimming assembly includes stops that limit rotation and at the same time provides an angular range of rotation of the frame that enables the trimming assembly to position the cutting edge of the trimming blade at the optimal cutting angle independent of the approach angle of the trimmer assembly during use.

8. The unit of claim 6 wherein the trimming assembly can rotate clockwise and counterclockwise providing an angular range of rotation of about 32°.

9. The unit of claim 1 wherein said pivot interface comprises a plurality of C-shaped members on the ends of the frame interfacing with pins disposed near the back of housing and supporting the frame therebetween.

10. The unit of claim 1 further comprising ball shaped pivots on the ends of the frame interfacing with ball shaped apertures in the housing and supporting the frame therebetween.

11. The unit of claim 1 further comprising cone shaped pivots on the ends of the frame interfacing with cone shaped apertures in the housing and supporting the frame therebetween.

12. The unit of claim 1 further comprising shell bearing pivots on the ends of the frame interfacing with shell shaped apertures in the housing and supporting the frame therebetween.

13. The unit of claim 1 further comprising torsion elastomers disposed on the ends of the frame interfacing with slots in the housing and supporting the frame therebetween.

14. A shaving blade unit comprising a disposable cartridge having a self leveling trimming assembly, the disposable cartridge comprising:

a housing having a primary guard at a front of the housing and a primary cap at an upper surface at a back of the housing;

one or more shaving blades disposed within the housing between the primary guard and the primary cap, said one or more shaving blades having blade tips oriented towards the front of the housing; and said trimming assembly pivotally mounted at the back of the housing, the trimming assembly comprising a frame supporting a trimming blade having a cutting edge oriented towards the back of the housing, a trimming guard disposed in front of the cutting edge of the trimming blade and a trimming cap disposed behind the cutting edge of the trimming blade, wherein said trimming assembly pivots with respect to the housing.

15. The unit of claim 14 wherein an optimal cutting angle of the trimming blade is set at an angle relative to a plane that is tangent to the trimming guard skin contact point and the trimming cap skin contact point.

16. The unit of claim 15 wherein the optimal cutting angle of the trimming blade ranges from about 17° to about 35°.

17. The unit of claim 15 wherein the optimal cutting angle of the trimming blade is about 23.5° relative to the tangent line.

18. The unit of claim 14 wherein the trimming assembly can rotate clockwise and counterclockwise providing an angular range of rotation of about 32°.

* * * * *